United States Patent [19]

Iwaki

[11] Patent Number: 4,645,329

[45] Date of Patent: Feb. 24, 1987

[54] APPARATUS FOR SCANNING AN ORIGINAL

[75] Inventor: Hiroshi Iwaki, Kasai, Japan

[73] Assignee: Sanyo Electric Co. Ltd., Japan

[21] Appl. No.: 693,733

[22] Filed: Jan. 23, 1985

[30] Foreign Application Priority Data

Apr. 20, 1984 [JP] Japan ..... 59-80527
Apr. 20, 1984 [JP] Japan ..... 59-80529

[51] Int. Cl.[4] ..... G03G 15/00

[52] U.S. Cl. ..... 355/8; 355/11; 355/66

[58] Field of Search ..... 355/8, 11, 65, 66

[56] References Cited

U.S. PATENT DOCUMENTS 4,367,945 1/1983 Abe ..... 355/8 X
4,487,497 12/1984 Kimura et al. ..... 355/8
4,519,702 5/1985 Shigemura et al. ..... 355/8 X
4,533,233 8/1985 Kimura et al. ..... 355/8

*Primary Examiner*—R. L. Moses
*Attorney, Agent, or Firm*—Handal & Morofsky

[57] ABSTRACT

An apparatus for scanning an original comprises a guide bar extending in the direction of scanning an original, and a first carriage and a second carriage are mounted on this guide bar so as to be slidable along the guide bar, respectively. A first movable mirror for reflecting an image of the original is supported on the first carriage and a second movable mirror for reflecting again the image of the original reflected by the first movable mirror is supported on the second carriage, respectively. A zoom lens whose conjugate length is always constant is installed between the second movable mirror and a fixed mirror. The second carriage extends long in the direction of extension of the guide bar, and pulleys are mounted on both ends thereof. A wire is set round the two pulleys, and both ends of the wire are hooked by holders fixed a base body, also being fixed to the first carriage. A timing belt is set round a rotary shaft of a motor and an idler, and a part of the timing belt is fixed to the first carriage. When the motor is rotated, the first carriage moves and also the second carriage moves in the same direction at a speed of ½ of that of the first carriage.

9 Claims, 3 Drawing Figures

APPARATUS FOR SCANNING AN ORIGINAL

BACKGROUND OF THE INVENTION

1. Field of the Invention

The present invention relates to an apparatus for scanning an original. More specifically, the present invention relates to an apparatus for scanning an original which is employed for the electrophotographic copying machine, facsimile, document file or the like and scans an original while exposing the same.

2. Description of the Prior Art

One example of the conventional apparatuses for scanning an original is disclosed, for example, in the Japanese Patent Publication No. 20428/1983 published on Apr. 22, 1983, the Japanese Utility Model Publication No. 3297/1983 published on Jan. 26, 1974 and so forth. Since these conventional techniques employ a lens whose conjugate length varies with copying magnification, the position of the reflecting mirror is required to be moved in parallel with the optical axis of the lens every time a magnification changing operation is performed. Accordingly, it is complicated to set a wire for driving a reflecting mirror and therefore the overall mechanism is also complicated. With such a complicated mechanism, improvement in reliability and reduction in cost are impossible.

In addition, one example of the apparatuses for scanning an original capable of adjusting a length of a chain or wire for driving the reflecting mirror is disclosed, for example, in the Japanese Utility Model Publication No. 35717/1979 published on Oct. 30, 1979. However, this scanning apparatus has also a complicated mechanism, having the same problem as that of the prior art.

SUMMARY OF THE INVENTION

Therefore, the principal object of the present invention is to provide an apparatus for scanning an original having a simple mechanism.

Another object of the present invention is to provide an apparatus for scanning an original which can easily make a fine adjustment of the position of the reflecting mirror.

To be brief, the present invention is an apparatus for scanning an original wherein a zoom lens, for example, is employed whose conjugate length does not change even if the magnification changes, and thereby the way of setting a flexible slender transmitting member such as a wire for driving the reflecting mirror is simplified.

More specifically, the present invention is an apparatus for scanning an original which comprises a first carriage and a second carriage installed so as to be movable in the direction of scanning an original, a first movable mirror which is for reflecting an image of the original and is fixed to the first carriage, a second movable mirror which is fixed to the second carriage and is for reflecting again the image of the original reflected by the first movable mirror, a fixed mirror for reflecting the image of the original reflected by the second movable mirror toward a light receiving part, a lens of variable magnification which is installed between the fixed mirror and the second movable mirror and whose conjugate length is always constant, two pulleys which are installed separately from each other on the second carriage in the direction of length thereof, a first flexible slender transmitting member whose both ends are hooked in a fixed fashion on a base body which is set round two pulleys of the second carriage, and a part of which is fixed to the first carriage, a motor for driving the first carriage and the second carriage, an idler installed in the base body, and a second flexible slender transmitting member which is set round the rotary shaft of the motor and the idler and a part of which is fixed to the first carriage. Then, when the motor is driven, the first carriage is moved, and also the second carriage is moved in the same direction at a speed of one half thereof.

In accordance with the present invention, the conjugate length of the lens is always constant, and therefore the magnification changing operation does not require a movement of the position of the reflecting mirror in the direction of the optical axis of the lens. Accordingly, the method of setting a flexible slender transmitting member such as a wire which drives the reflecting mirror can be simplified, and also the overall mechanism can be simplified. Therefore, in accordance with the present invention, an apparatus for scanning an original which is more economical and highly reliable can be realized.

In a preferred embodiment in accordance with the present invention, the first flexible slender transmitting member is fixed in a manner that the positions of the both ends thereof with respect to the base body is adjustable. Therefore, in accordance with the present preferred embodiment, a fine adjustment of the position of the reflecting mirror can be made in response to the depth of focus of the lens of variable magnification and the like. For this reason, the image of the original can be produced sharply on the light receiving part even when a bright lens with shallow depth of focus is employed as a lens of variable magnification. Furthermore, in accordance with the present embodiment, such an advantage is also obtainable that the position is adjustable to correct an accumulated tolerance of parts and thereby assembling and adjustment are facilitated.

These objects and other objects, features, aspects and advantages of the present invention will become more apparent from the following detailed description of the embodiments of the present invention when taken in conjunction with accompanying drawings.

DESCRIPTION OF THE PREFERRED EMBODIMENTS

Figure 1:
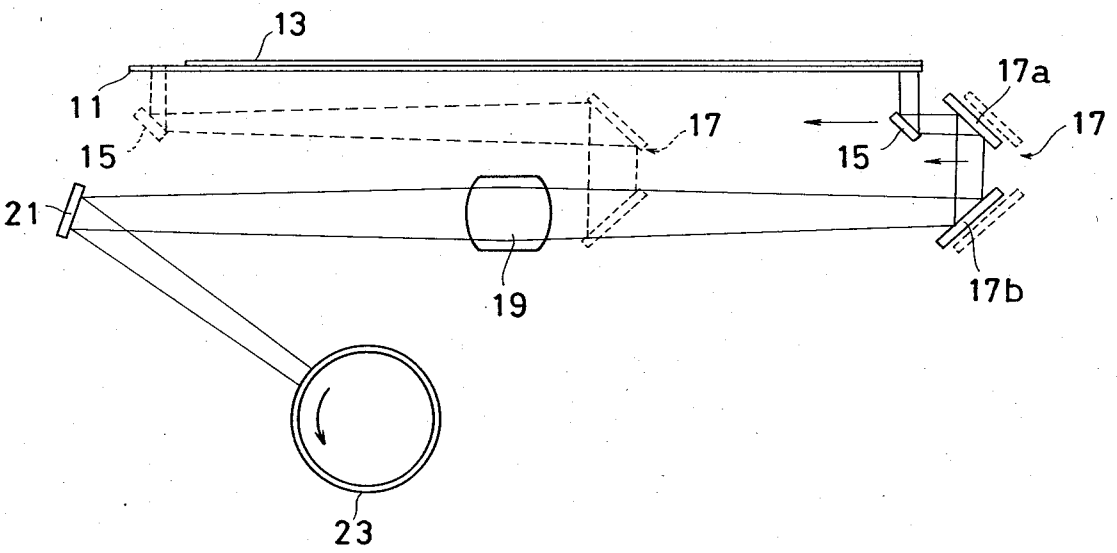
FIG. 1 is an illustrative view for explaining the principle of a mechanism whereto the present invention is applied and which scans an original while exposing it.

FIG. 1 is an illustrative view showing the principle of scanning and exposing an original. In an embodiment as described hereafter, an example is shown where the present invention is applied to an electrophotographic copying machine, however, it is pointed out in advance that the present invention is applicable likewise to an equipment requiring exposure-scanning of a original such as a facsimile, a document file or the like not limited to the electrophotographic copying machine.

In reference to FIG. 1, an original table 11 composed of a clear glass, for example, is installed on the top of the electrophotographic copying machine, and an original 13 is placed on the top surface of this original table 11. A first movable mirror 15 and a second movable mirror 17 are installed under the original table 11. Associated with this first movable mirror 15, though not illustrated, a rod-shaped light source such as a fluorescent lamp is provided which extends in the direction orthogonal to that of scanning the original 13. Then, a light from this light source (not illustrated) is irradiated onto the original 13 through the original table 11, and the light reflected from the original 13 is reflected toward the second movable mirror 17 by the first movable mirror 15. The second movable mirror 17 comprises two reflecting mirrors 17*a* and 17*b* which are orthogonal to each other, and further reflects the image of the original reflected by the first movable mirror 15 toward a zoom lens 19. The conjugate length of this zoom lens 19 is always constant even if the magnification is varied. Then, the image of the original which is reflected from the second movable mirror 17 and passes through the zoom lens 19 is reflected toward the light receiving surface, that is, the surface of a photosensitive drum 23 by a fixed mirror 21. Accordingly, the image of the original is focussed and formed on the surface of this drum 23.

Because the zoom lens 19 whose conjugate length is always constant is employed, even if an operation of changing magnification thereof is performed to change the copying magnification, adjustment of the positions of the first and the second movable mirrors 15 and 17 at each operation is not required. Accordingly, a mechanism for adjusting the positions of the movable mirrors associated with the operation of changing magnification can be dispensed with, and thereby a driving mechanism by means of a wire as described later is simplified.

Figure 2:
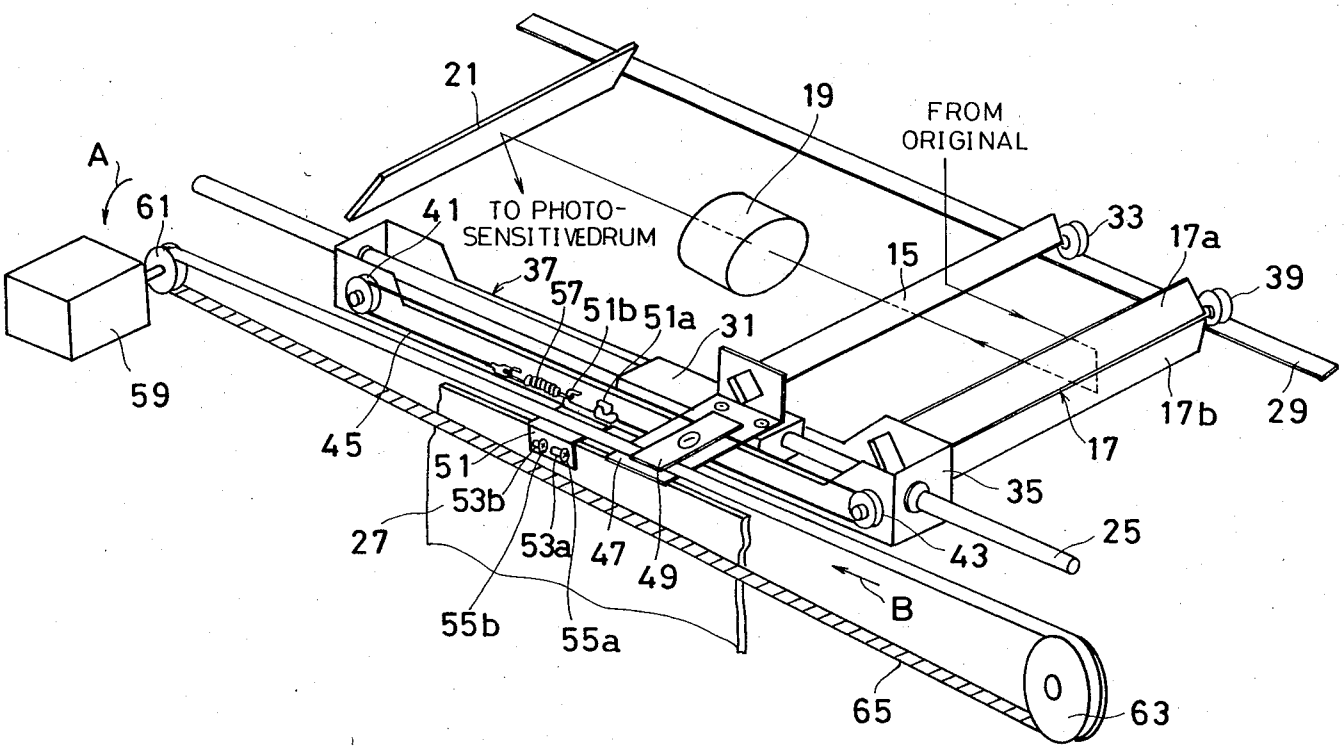
FIG. 2 is a perspective view showing the major part of one embodiment in accordance with the present invention.
Figure 3:
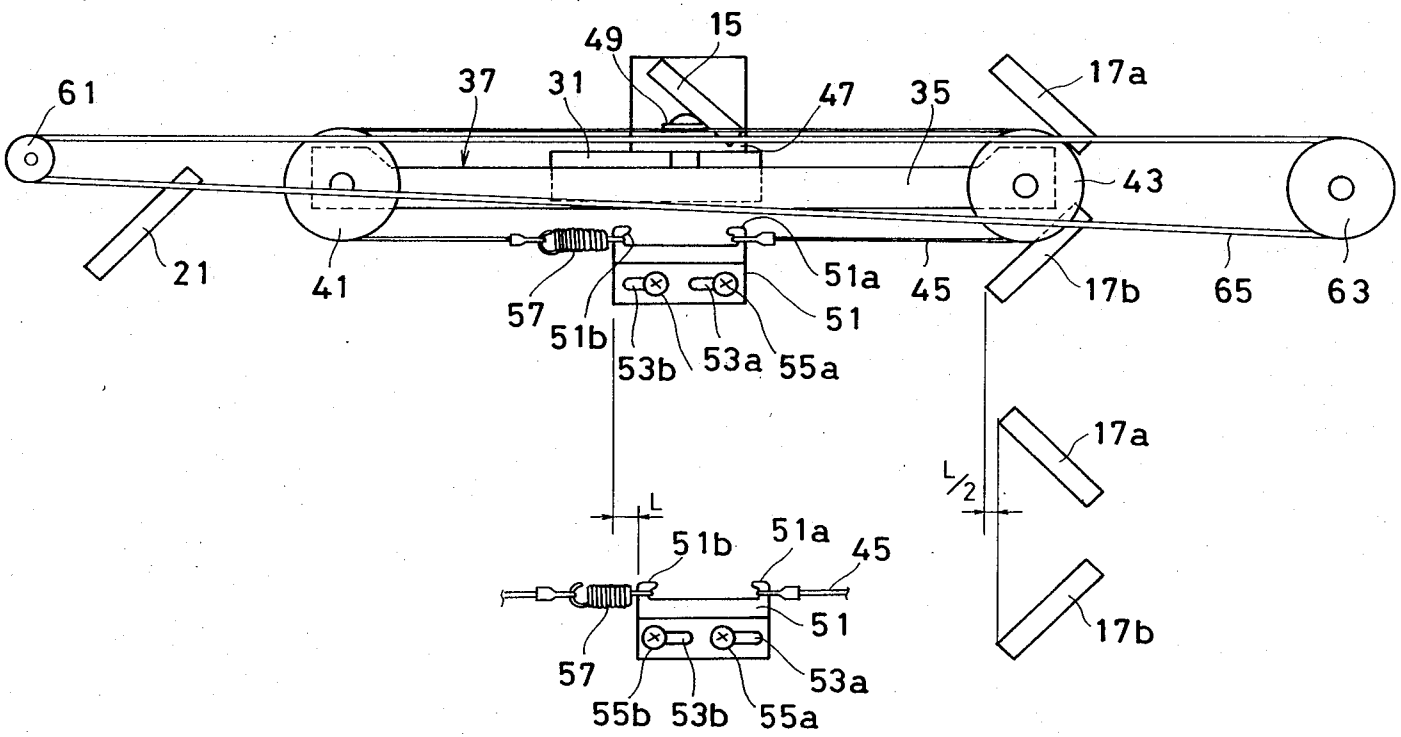
FIG. 3 is a schematic side view of the present embodiment.

Detailed description is made on an embodiment in accordance with the present invention in reference to FIG. 2 and FIG. 3. A guide bar 25 is provided so as to extend in the direction of scanning the original 13 (FIG. 1), that is, the direction of the optical axis of the zoom lens 19, and both ends of this guide bar 25 are mounted on a base body 27 in a fixed fashion, although not illustrated in detail. A guide rail 29 is provided at the opposite side of the guide bar 25 with the zoom lens 19 located in between, and extends in parallel with the guide bar 25. This guide rail 29 is also mounted on the base body 27 in a fixed fashion.

A first carriage 31 is supported by the guide bar 25 so as to be freely slidable along the guide bar 25 in the direction of the optical axis of the lens 19. One end of the above-described first movable mirror 15 is fixed to this first carriage 31. A wheel 33 is attached free-rotatably to the other end of the first movable mirror 15. Accordingly, the other end of the first movable mirror 15 is supported by the guide rail 29 through this wheel 33. Meanwhile, as is described above, the rod-shaped light source (not illustrated) is installed associated with the first movable mirror 15.

A second carriage 35 is supported by the guide bar 25 so as to be slidable in the direction of the axis of the guide bar 25. This second carriage 35 is composed of a box-shaped member whose top end is opened, and on this top end part, a cut-out or notch 37 is formed to prevent an interference with the bottom end of the first carriage 31. Meanwhile, the second carriage 35 may be supported by another guide bar (not illustrated) installed in parallel with the guide bar 25 rather than by the guide bar 25.

One end of the second movable mirror 17 composed of the two reflecting mirrors 17*a* and 17*b* as described above is fixed to one end in the longitudinal direction of the second carriage 35. A wheel 39 is installed free-rotatably at the other end of this second movable mirror 17, and accordingly the other end of the second movable mirror 17 is supported by the guide rail 29 through this wheel 39. Then, the image of the original reflected by the first movable mirror 15 is reflected again by the second movable mirror 17, and plunges into the fixed mirror 21 through the zoom lens 19, being further reflected from this fixed mirror 21 toward the light receiving surface, for example, the photosensitive drum 23 (FIG. 1) as described above. The fixed mirror 21 is mounted on the base body 27 in a fixed fashion.

On the other surface of one side wall of the second carriage 35, pulleys 41 and 43 are mounted free-rotatably on both ends in the longitudinal direction of this second carriage 35. A wire 45 is set round this two pulleys 41 and 43. This wire 45 is for driving the first carriage 31 and the second carriage 35 to move, and for this purpose, the wire 45 is fixed to the first carriage 31 at a part thereof in the longitudinal direction. More specifically, to the top end of the first carriage 31, a wire supporting plate 47 is fixed so as to protrude beyond the side thereof. Then, a part of the wire 45 is placed on this wire supporting plate 47, and a part of the placed wire is pressed by a pressing plate 49. That is, a part of the wire 45 is fixed to the first carriage 31 by the wire supporting plate 47 and the pressing plate 49.

Then, a wire holder 51 is fixed to the predetermined position of the base body 27. Hook pieces 51*a* and 51*b* are formed on the top surface of this wire holder 51. Then, one end of the wire 45 is hooked by the hook piece 51*a* and the other end of the wire 45 is hooked by the other hook piece 51*b* through a coil spring 57, which serves as a means to maintain a tension in wire 45.

Furthermore, preferably, two oblong holes 53*a* and 53*b* which extend in the direction parallel to that of the axis of the guide bar 25 are formed on the wire holder 51. Accordingly, the position of fixing the wire holder 51 is shifted by screws 55*a* and 55*b* by utilizing these oblong holes 53*a* and 53*b*, and thereby the position of the second carriage 35, that is, the second movable mirror 17 can be adjusted. That is, in reference to FIG. 3, by moving the wire holder 51 by a distance of L, the second movable mirror 17 can be moved in the same direction by a distance of L/2. Thus, by constituting so that a fine adjustment of the position of the both ends of the wire 45 with respect to the base body 27 can be made, a fine adjustment of the position of the reflecting mirror 17 can be made according to the depth of focus of the lens of variable magnification or the zoom lens 19.

Meanwhile, for the flexible slender transmitting member, a similar member, for example, a belt may be used in place of the above-mentioned wire 45.

A motor 59 is provided, and a timing pulley 61 of the driving side is fixed to the rotary shaft of this motor 59. On the other hand, a timing pulley 63 of the following side as an idler is installed free-rotatably on the base body 27. A timing belt 65 is set round the two timing pulleys 61 and 63. Then, a part of this timing belt 65 is fixed to the first carriage 31 together with the wire 45 by means of the above-described wire supporting plate 47 and pressing plate 49.

When the motor 59 is driven and the timing pulley 61 is rotated in the direction as shown by an arrow mark A in FIG. 2, resultingly the first carriage 31 fixed to the timing belt 65 is move at a certain speed V in the direction as shown by an arrow mark B in FIG. 2. At this time, if an exposure lamp (not illustrated) is lit, the original 13 (FIG. 1) is exposed while scanned. Then, when the first carriage 31 is moved at a speed of V in the direction as shown by the arrow mark B, one pulley 63 mounted on the second carriage 35 performs a function of driving pulley, and accordingly the second carriage 35 is moved in the same direction as that of the first carriage 31, that is, the direction as shown by the arrow mark B at a speed of V/2. For this reason, when the original is scanned while exposed by the first movable mirror 15, the distance from the surface of the original to the zoom lens 19 always becomes constant.

Meanwhile, in the above-described embodiment, the second movable mirror 17 is constituted by employing the two reflecting mirrors 17*a* and 17*b*. However, the second movable mirror may be constituted with one reflecting mirror.

In addition, the combination of the timing pulley and the timing belt may be replaced by another similar belt-shaped transmitting member, for example, a wire or the like.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for scanning an original comprising:

a base body, a first carriage which is installed so as to be movable in the direction of scanning an original, a first movable mirror which is held on said first carriage and is for reflecting an image of the original, a second movable mirror for reflecting again said image of the original reflected by said first movable mirror, a second carriage which is for holding said second movable mirror and is installed so as to be slidable in the same direction as that of said first carriage, a fixed mirror for reflecting said image of the original reflected by said second mirror toward a light receiving part, a lens of variable magnification which is installed between said fixed mirror and said second movable mirror and whose conjugate length is always constant, two pulleys which are installed separately from each other on said second carriage in the direction of movement thereof, a first flexible slender transmitting member which is set round said two pulleys, a part of which is fixed to said first carriage, and both ends of which are fixed to said base body, a motor having a rotary shaft, an idler which is installed free-rotatably on said base body, and second flexible slender transmitting member which is set between the rotary shaft of said motor and said idler and a part of which is fixed to said first carriage.

2. An apparatus for scanning an original in accordance with claim 1, which further comprises a fixture which is fixed to said base body and has hook parts, and wherein both ends of said first flexible slender transmitting member is hooked by said hook part of said fixture.

3. An apparatus for scanning an original in accordance with claim 2, whichi further comprises a tensing means which is inserted between at least one end of said first flexible slender transmitting member and said hook part.

4. An apparatus for scanning an original in accordance with claim 1, which further comprises a position changing means for changing positions of both ends of said first flexible slender transmitting member with respect to said base body.

5. An apparatus for scanning an original in accordance with claim 4, which further comprises a fixture which is mounted on said base body and has hook parts, and wherein both ends of said first flexible slender transmitting member are hooked by said hook parts of said fixture.

6. An apparatus for scanning an original in accordance with claim 5, wherein said position changing means includes oblong holes which are formed by extending in the direction of scanning said original on at least one of said fixture and said base body.

7. An apparatus for scanning an original in accordance with claim 1, which further comprises a supporting lever which is installed by extending in the direction of scanning said original, and wherein said first carriage is supported by said supporting lever in a freely slidable fashion.

8. An apparatus for scanning an original in accordance with claim 7, wherein said second carriage is supported by said supporting lever in a freely slidable fashion.

9. An apparatus for scanning an original in accordance with claim 7, wherein said second carriage is supported by a supporting lever other than said supporting lever and parallel thereto.

* * * * *